United States Patent [19]

Tomlinson

[11] Patent Number: 4,703,917

[45] Date of Patent: Nov. 3, 1987

[54] MANUAL WINCH WITH DRUM RELEASE AND HANDLE STORAGE

[75] Inventor: Mack B. Tomlinson, Atlanta, Ga.

[73] Assignee: Carfel Inc., Miami, Fla.

[21] Appl. No.: 873,768

[22] Filed: Jun. 12, 1986

[51] Int. Cl.[4] ..... B66D 3/14; B66D 5/34

[52] U.S. Cl. ..... 254/369; 254/376

[58] Field of Search ..... 254/217, 218, 369, 376, 254/352, 357, 323, DIG. 3; 188/82.3, 82.34; 74/543, 544

[56] References Cited

U.S. PATENT DOCUMENTS

| | | | |
|---|---|---|---|
| 815,586 | 3/1906 | Fuller et al. | 254/217 |
| 1,112,998 | 10/1914 | Granlund | 254/218 |
| 1,124,451 | 1/1915 | Irwin | 254/369 |
| 1,230,211 | 6/1917 | Paul | 254/369 |
| 1,498,730 | 6/1924 | Hollingsworth | 254/218 |
| 1,508,750 | 9/1924 | Nabors | 254/323 |
| 1,857,579 | 5/1932 | Armstrong | 254/369 X |
| 2,891,824 | 6/1959 | Fulton | 254/357 X |
| 3,279,760 | 10/1966 | Bathum | 254/376 |
| 3,724,816 | 4/1973 | Cain et al. | 254/369 |

FOREIGN PATENT DOCUMENTS

| | | | |
|---|---|---|---|
| 1441409 | 6/1976 | United Kingdom | 254/323 |

*Primary Examiner*—Stuart S. Levy
*Assistant Examiner*—Katherine Matecki
*Attorney, Agent, or Firm*—Fleit, Jacobson, Cohn & Price

[57] ABSTRACT

A manual winch which includes two manually operable release levers for the ratchet mechanism both of which must be manually held in retracted position in order to enable free unwinding of a cable from the winch drum. Specifically, a latch structure is provided for the drum ratchet release lever and a pin is provided to hold the retrieving ratchet release lever disengaged thereby enabling an operator to unwind cable from the winch drum without hand holding the release levers in released position. The winch includes a handle for manually winding a cable on a drum with a storage arrangement being provided for the handle to retain it in stored position when not in use.

2 Claims, 3 Drawing Figures

MANUAL WINCH WITH DRUM RELEASE AND HANDLE STORAGE

BACKGROUND OF THE INVENTION

1. Field of the Invention

The present invention generally relates to a manual winch which includes two manually operable release levers for the ratchet mechanism both of which must be manually held in retracted position in order to enable free unwinding of a cable from the winch drum. Specifically, a latch structure is provided for the drum ratchet release lever and a pin is provided to hold the retrieving ratchet release lever disengaged thereby enabling an operator to unwind cable from the winch drum without hand holding the release levers in released position. The winch includes a handle for manually winding a cable on a drum with a storage arrangement being provided for the handle to retain it in stored position when not in use.

2. Information Disclosure Statement

Various types of manual winches are available in which a ratchet mechanism is provided to wind a cable on a winch drum. In order to freely unwind the cable from the winch drum, it is necessary to manually hold two release levers in released or unlocked position while at the same time exerting tension on the cable. This frequently requires two people, one to hold the levers in released position and another to exert tension on the cable for unwinding it from the winch drum. Winches of this type are frequently mounted on vehicles, such as all terrain vehicles, so that the vehicle may be manually moved by unwinding the cable from the winch drum, attaching the cable to a stationary object, such as a tree or the like, and manually winding the cable onto the winch drum by utilizing a handle and ratchet mechanisms associated with the winch drum so that the vehicle can be pulled to a desired location. Conventional manually operated winches of this type include a release lever for the winch drum and a release lever for the retrieving ratchet associated with the manually oscillatable handle so that both of these levers must be held in released position in order to unwind the cable from the winch drum.

SUMMARY OF THE INVENTION

An object of the invention is to provide a manual winch with a manually operated retainer for retaining the release lever for the winch drum ratchet in released position and a retaining pin for retaining the cable retrieving ratchet release lever in released position thereby enabling the operator to unwind the cable from the winch drum without hand holding the ratchet release levers in released position.

Another object of the invention is to provide a winch having a handle removably received in a handle receiving sleeve on the cable retrieving ratchet assembly together with a storage sleeve rigidly affixed to a supporting housing or similar structure on the winch with a set screw to retain the operating handle in stored position when not in use thereby assuring that the handle will be readily accessible when it is desired to be inserted into the handle receiving sleeve on the retrieving ratchet assembly.

A further object of the invention is to provide a winch in accordance with the preceding objects in which the release lever for the winch drum ratchet is retained in released position by a spring clip of resilient wire in the form of an angulated loop having one end pivotally secured to a housing adjacent the release lever so that the other end of the spring clip may engage the release lever to retain it in released position with the spring clip being pivoted to an out of the way position when not in use.

Still another object of the invention is to provide a manual winch in accordance with the preceding object in which the retaining pin for retaining the retrieving ratchet release lever in released position is inserted through an aperture in the release lever so that it engages the housing of the retrieving ratchet assembly to retain the release lever in released position with the retaining pin being tethered to the housing or base plate of the winch by a flexible tether chain or the like.

A still further object of the invention is to provide a manual winch for use on all terrain vehicles and the like which is modified to provide a storage facility for the manual handle used to retrieve the cable by winding it onto a winch drum together with retaining devices to retain the ratchet release levers on the winch in released position to enable an operator to unwind the cable with the modifications of the conventional winch being relatively simple but yet effective for their purposes.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
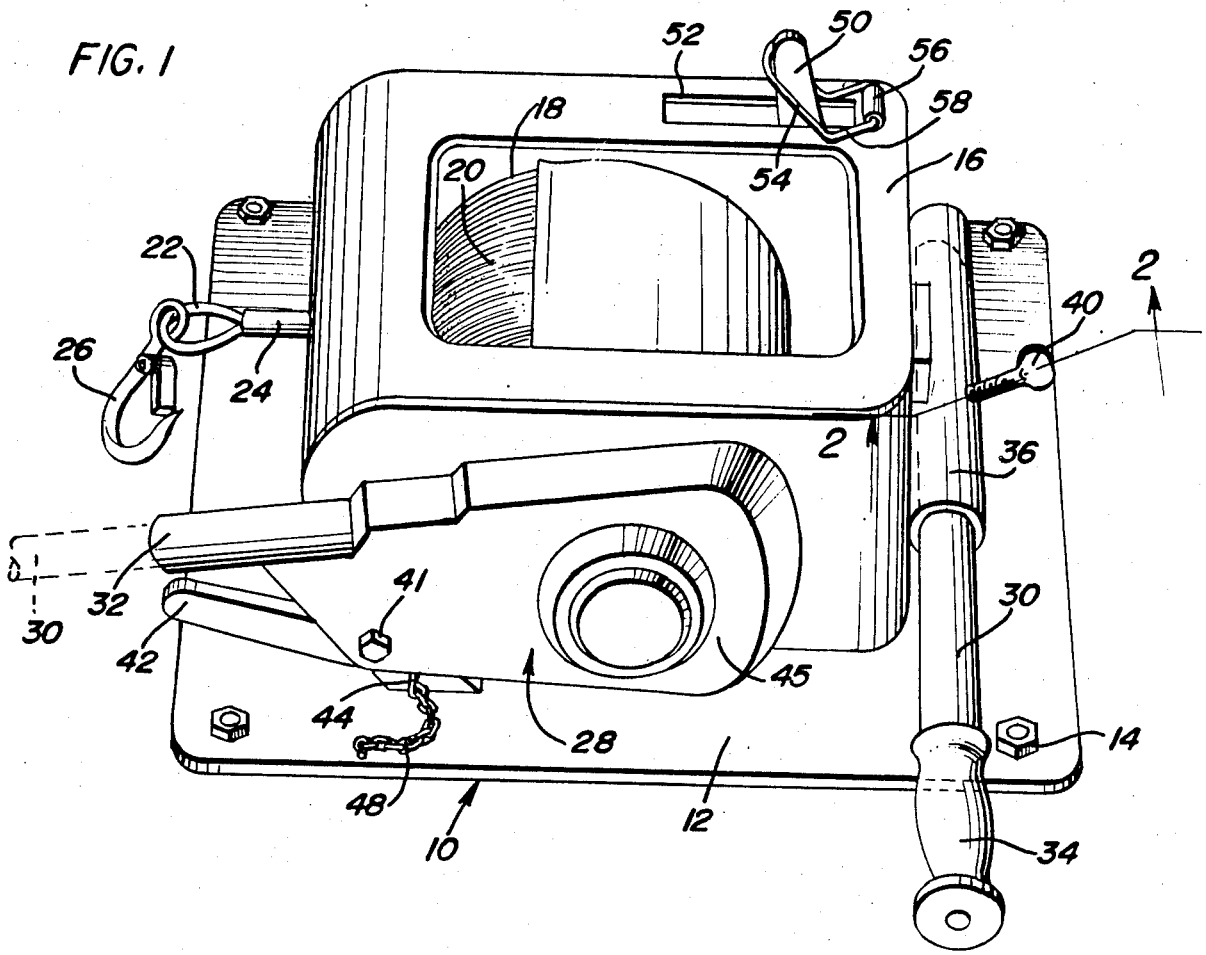
FIG. 1 is a perspective view of the manual winch of the present invention with the modifications incorporated therein.
Figure 2:
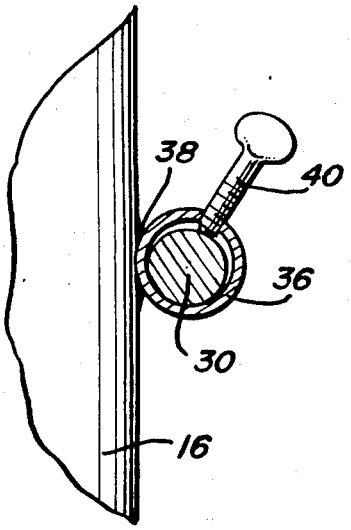
FIG. 2 is a sectional view taken substantially upon a plane passing along section line 2—2 on FIG. 1 illustrating further structural details of the handle storage sleeve and set screw and illustrating the association of the handle therewith.

Referring now specifically to the drawings, the winch is generally designated by the numeral 10 and includes a base plate 12 and retaining bolts 14 by which the base plate may be supported on a rack normally provided on an all terrain vehicle (not shown). Supported from the base plate 12 is a housing or framework 16 rotatably journalling a winch drum 18 therein with the winch drum 18 including flexible cable 20 wound thereon with the free end of the cable having an eye 22 secured in place by a ferrule 24 and a snap hook 26 attached to the eye 22. All of the previously mentioned structure represents a conventional manually operated winch such as used frequently on a vehicle such as all terrain vehicles.

Figure 3:
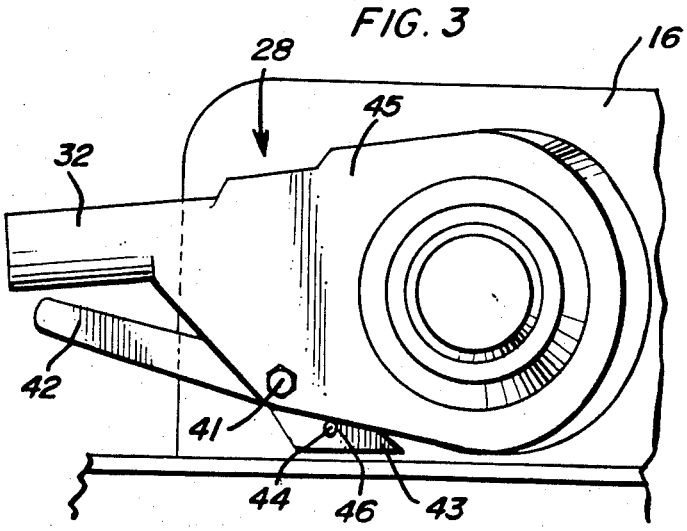
FIG. 3 is an elevational view of the retrieving ratchet assembly illustrating the association of the release lever and retaining pin.

The winch is conventional and commercially available and the additions made thereto and forming this invention do not change the operation thereof. This type of winch includes a cable retrieving ratchet assembly generally designated by the numeral 28 which is oscillatable about a horizontal axis and is utilized with a handle 30 received in a handle receiving sleeve 32 by which the ratchet assembly 28 may be oscillated so that the retrieving ratchet will incrementally rotate the winch drum in one direction to wind the cable 20 thereon when the ratchet assembly 28 is oscillated by moving the hand grip 34 at the free end of the handle 30 generally in a vertical plane. The handle 30 telescopes into and is removable in relation to the sleeve 32 so that it can be inserted into a longitudinally elongated storage sleeve 36 affixed to the housing or frame 16 as by welding 38 or the like with a screw threaded set screw 40 threaded through the sleeve 36 to secure the handle 30 in stored position generally in parallel relation to the base plate 12 and slightly above the base plate 12 so that it will be in an out of the way position but yet readily accessible when it is desired to manually wind the cable 20 onto the winch drum 18 by operating the ratchet assembly 28. A retrieving ratchet lever 42 is incorporated into the ratchet assembly 28 and in order to manually release the retrieving ratchet assembly when it is desired to enable the cable to be unwound from the winch drum 18, the point 43 of the lever 42 must be moved outwardly so that it does not engage a ratchet gear forming part of the assembly 28. As shown in FIG. 3, the lever 42 has been manually pivoted about pivot bolt 41 to a position with point 43 disengaged and is held in that position while the cable 20 is pulled outwardly by a retaining pin 44 which is inserted through an aperture 46 in the the lever 42 and engages the retrieving lever housing 45 to retain the lever 42 in released position. The retaining pin 44 is tethered to the base plate 12 by a tether line 48 in the form of a chain, cable or the like so that it will not become lost when not in use.

Also, the winch 10 includes a pivotally mounted release lever 50 for the winch drum ratchet which projects upwardly through a slot 52 in the upper end of the housing or frame 16. The release lever 50 also has to be manually moved and retained in a released position while the cable 20 is being unwound from the winch drum 18. In order to facilitate unwinding of the cable 20, a spring clip 54 is pivotally mounted in a sleeve 56 on the upper end of the housing 16 adjacent the slot 52 with the spring clip 54 being generally of loop configuration and angulated as at 58 so that the spring clip can be engaged with the outer end of the release lever 50 to retain the lever 50 in released position when the spring clip 54 is in the position illustrated in FIG. 1. The spring clip can be pivoted about an axis defined by the sleeve 56 to an out of the way position alongside of the housing 16 so that the release lever 50 can operate in the usual manner.

Thus, by locking the release lever in released position by using the spring clip 54 and locking the release lever 42 in released position by using the locking pin 44, both of the ratchet mechanisms associated with the winch drum can be retained in released position without the operator physically holding the levers in released position. The cable 20 then can be unwound from the drum by pulling outwardly on the cable with the winch drum being rotated in response to outward movement of the cable thereby enabling the cable to be engaged with a stationary object such as tree or the like so that the all terrain vehicle on which the winch is mounted can be pulled to a desired position such as being pulled from a ditch onto a roadway or the like or a load can be pulled toward the vehicle.

The storage sleeve 36 for the handle 30 provides a convenient place to store the handle and the set screw 40 will securely retain the handle in place in the storage sleeve during normal use of the vehicle with the handle being in position for removal from the storage sleeve and insertion into the sleeve 32 for operating the ratchet assembly 28 in order to wind the cable onto the cable drum by rotating the drum in the appropriate direction. However, when the cable is desired to be quickly unwound from the drum, the release levers 42 and 50 are locked in their lever release positions by the use of the pin 44 and the spring clip 54 respectively thus enabling the cable 20 to be unwound by rotating the drum 18 when the cable is pulled outwardly without the necessity of the operator holding both of the levers 42 and 50 in released position.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a manual winch having a rotatable winch drum and flexible cable wound thereon, a first manually operated ratchet mechanism to rotate the drum and a second manually operated ratchet mechanism to retain the drum in rotated position, a first release lever for said first ratchet mechanism and a second release lever for said second ratchet mechanism, the improvement comprising first and second means for retaining said first and second release levers in released position for disengaging said ratchet mechanisms to enable the winch drum to be freely rotated when the cable is tensioned to enable the cable to be unwound from the drum without manually holding said first and second release levers in released position, said first release lever including a pivotal lever, said first means retaining the first release lever in released position including an aperture in said first release lever, a pin insertable through said aperture in said first release lever, said first ratchet mechanism including a housing supporting said first release lever, said pin engaging said housing to retain said first release lever in released position, said second release lever including a pivotal lever, said second ratchet mechanism including a housing receiving said second release lever and including a slot, said second release lever having a free end projecting through said slot, said second means retaining the second release lever in released position including a spring clip in the form of a loop having one end portion pivotally supported from said housing and the opposite end engaged with said free end of said second release lever to retain the second release lever in released position, said spring clip being in the form of a generally rectangular loop of spring wire having an angulated portion engaged with the housing to limit the pivotal movement of the spring clip in one direction for enabling the spring clip to retain said second release lever in released position.

2. The combination as defined in claim 1 wherein said winch includes a base plate and housing structure with the base plate including means to secure it to a rack on an all terrain vehicle, said first ratchet mechanism including a removable rod-like handle for oscillating said first ratchet mechanism to rotate the drum, and a storage means for said handle to retain the handle in a stored position separate from said first ratchet mechanism, said storage means including a sleeve rigidly affixed to said housing structure with the sleeve having an open end for telescopically receiving the handle and a set screw for securing the handle in the sleeve to securely retain it in stored position.

* * * * *